US007753707B1

(12) United States Patent
Ju

(10) Patent No.: US 7,753,707 B1
(45) Date of Patent: Jul. 13, 2010

(54) ELECTRICAL CONNECTING ASSEMBLY

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/429,183

(22) Filed: Apr. 24, 2009

(51) Int. Cl.
*H01R 4/50* (2006.01)

(52) U.S. Cl. ..... 439/342

(58) Field of Classification Search ..... 439/342, 439/259, 70, 83, 135
See application file for complete search history.

(56) References Cited

U.S. PATENT DOCUMENTS

| | | | | |
|---|---|---|---|---|
| 6,071,140 | A * | 6/2000 | McHugh et al. | 439/342 |
| 6,254,415 | B1 * | 7/2001 | Mizumura et al. | 439/342 |
| 6,338,640 | B1 * | 1/2002 | Lin | 439/342 |
| 6,500,019 | B1 * | 12/2002 | Tan | 439/342 |
| 6,609,926 | B1 * | 8/2003 | Chen et al. | 439/342 |
| 6,663,409 | B1 * | 12/2003 | Liao et al. | 439/342 |
| 6,669,500 | B1 * | 12/2003 | Ju | 439/342 |
| 6,814,603 | B2 * | 11/2004 | Okita et al. | 439/342 |
| 6,859,370 | B1 * | 2/2005 | Hsu et al. | 361/752 |
| 6,921,276 | B2 * | 7/2005 | McClinton | 439/342 |
| 7,056,140 | B1 * | 6/2006 | Jiang | 439/342 |
| 7,563,120 | B1 * | 7/2009 | Jin | 439/342 |
| 7,572,136 | B2 * | 8/2009 | Liao | 439/342 |
| 7,641,496 | B2 * | 1/2010 | Xu et al. | 439/342 |
| 2005/0054754 | A1 | 3/2005 | Fan et al. | |
| 2005/0215102 | A1 * | 9/2005 | Yu et al. | 439/342 |
| 2006/0141841 | A1 * | 6/2006 | Liao et al. | 439/342 |
| 2008/0280473 | A1 * | 11/2008 | Zhou et al. | 439/259 |

FOREIGN PATENT DOCUMENTS

CN 2833952 Y 11/2006

* cited by examiner

*Primary Examiner*—T C Patel
*Assistant Examiner*—Harshad C Patel
(74) *Attorney, Agent, or Firm*—Pai Patent & Trademark Law Firm; Chao-Chang David Pai

(57) ABSTRACT

An electrical connecting assembly includes an insulating base, terminals, a PCB, a cover, and a driving unit. The insulating base has receiving holes and a first hole. The terminals are disposed in the receiving holes. The PCB has a first connecting area and has a second connecting area. The cover can be moved horizontally on the insulating base. The cover has a second hole. The driving unit has one metal sheath, at least one welding portion, and one cam piece. Two ends of the welding portion are respectively connected to the metal sheath and the second connecting area. The cam piece has an actuating portion, a first cam shaft, and a second cam shaft which is eccentric with first cam shaft. The first cam shaft is disposed inside the first hole and is held by the metal sheath. The second cam shaft is disposed inside the second hole.

24 Claims, 13 Drawing Sheets

ELECTRICAL CONNECTING ASSEMBLY

BACKGROUND OF THE INVENTION

1. Field of the Invention

The present invention relates to an electrical connecting assembly and in particular to an electrical connecting assembly with improved stability of connection.

2. Description of Related Art

With low weight, small size, and portability of electronic products, it is necessary for arranging more terminals on the limited base of the electrical connector to connect with the pins of central processing unit.

Please refer to FIG. 1; a connector disclosed in CN2833952 includes a first base (a), a first driving unit (b), a cam (c), and a supporting plate (d) on the top of the first base (a). The first base (a) has four receiving slots (a1) and one shaft slot (a2). The first driving unit (b) has a driving portion (b1) and a shaft portion (b2). The cam (c) has a through hole (c1) and the shaft portion (b2) and the through hole (c1) operate in coordination so that the rotation of the driving portion (b1) can drive the cam (c) to rotate. The middle portion of the supporting plate (d) has a convex portion (d1) and the convex portion (d1) has a central hole (d2). Furthermore, the supporting plate (d) has four foot portions (d3) extending downwardly therefrom and each foot portion (d3) is inserted into the corresponding receiving slot (a1) so as to locate the supporting plate (d) firmly on the first base (a).

While assembling, the cam (c) is disposed on the top of first base (a) and the through hole (c1) is positioned correspondingly to the shaft slot (a2). Next step is disposing the supporting plate (d) on the cam (c) so as to accommodate the cam (c) between the convex portion (d1) and the first base (a). The central hole (d2) is corresponding to the through hole (c1) and shaft slot (a2). Each foot portion (d3) is inserted into the receiving slot (a1) so as to locate the supporting plate (d) firmly on the first base (a). The last step is inserting the shaft portion (b2) into the central hole (d2), the through hole (c1) and shaft slot (a2). A user can use a tool to rotate the driving portion (b1) to drive the cam (c) to rotate.

The disadvantage of the connector is described as follows. Depending on the larger reaction force acting on the pins of the CPU by the terminals, the reaction force is transferred to the supporting plate (d) and the first base (a) via the shaft portion (b2). The supporting plate (d) can simply improve the strength of the first base (a) with a small degree. Furthermore, because the supporting plate (d) is only connected to the first base (a) but not connected to the PCB (not shown), the reaction force can not be transferred to the PCB (not shown). Therefore, the front end of the first base (a) may have expansion due to the high force concentration.

Another connector is disclosed in US 20050054754 and the connector includes a second driving unit and a second base. The second base has a metal piece on the front end thereof and has a shaft slot for accommodating the shaft of the second driving unit.

The metal piece is provided for improving the strength of the second base so that the expansion issue of the front end of the second base in the condition of higher reaction force is solved. However, with the higher force to rotate the driving unit, the force acting on the inner wall of the shaft slot is increasing. Because the shaft is directly inserted into the shaft slot without any buffering piece, the shaft slot will be abraded by the higher force so that the radius of the shaft slot will be extended. The extended shaft slot results in the loose connection between the shaft and the shaft slot and the stability of the connector is decreased.

Therefore, in view of this, the inventor proposes the present invention to overcome the above problems based on his expert experience and deliberate research.

SUMMARY OF THE INVENTION

The primary object of the present invention is to provide an electrical connecting assembly. The electrical connecting assembly is provided for solving the problems of expanding hole and the expansion of the connector.

In order to achieve the above object, the present invention provides an electrical connecting assembly, which is used for electrically connecting a chip module. The electrical connecting assembly comprises an insulating base, a plurality of terminals, a PCB (printed circuit board), a cover, and a driving unit. The insulating base has a plurality of receiving holes and a first hole thereon. The terminals are disposed in the receiving holes, and the PCB is disposed under the insulating base. The PCB has a first connecting area corresponding to the receiving holes for welding the terminals on the first connecting area, and a second connecting area for the driving unit being welded on. The cover is disposed and can be moved horizontally on the insulating base for carrying the chip module. The cover has a plurality of opening holes corresponding to the receiving holes and the pins penetrate through the opening holes to connect with the terminals in the receiving holes, and the cover has a second hole. The driving unit at least has one metal sheath disposed in the first hole, at least one welding portion, and one cam piece. One end of the welding portion is connected to the metal sheath, and the other end of the welding portion is welded on the second connecting area. The cam piece has an actuating portion, a first cam shaft extending from the actuating portion, and a second cam shaft formed between the first cam shaft and the actuating portion. The first cam shaft is disposed inside the first hole and the first cam shaft is held by the metal sheath. The second cam shaft and the first cam shaft are eccentric with each other. The second cam shaft is disposed inside the second hole.

The electrical connecting assembly comprises an insulating base, a plurality of terminals, a PCB (printed circuit board), a cover, and a driving unit. The insulating base has a plurality of receiving holes and a first hole thereon. The terminals are disposed in the receiving holes, and the PCB is disposed under the insulating base. The PCB has a first connecting area corresponding to the receiving holes for welding the terminals on the first connecting area, and a second connecting area for the driving unit being welded on. The cover is disposed and can be moved horizontally on the insulating base for carrying the chip module. The cover has a plurality of opening holes corresponding to the receiving holes and the pins penetrate through the opening holes to connect with the terminals in the receiving holes, and the cover having a second hole. The driving unit is welded on the second connecting area. The driving unit at least has one metal sheath disposed in the first hole, at least one welding portion, a connecting portion disposed on the insulating base, and one cam piece. The connecting portion is connected between the metal sheath and the welding portion. One end of the welding portion is connected to the metal sheath, and the other end of the welding portion is welded on the second connecting area. The cam piece has an actuating portion, a first cam shaft extending from the actuating portion, and a second cam shaft formed between the first cam shaft and the actuating portion. The first cam shaft is disposed inside the first hole and the first cam shaft is held by the metal sheath. The second cam shaft and the first cam shaft are eccentric with each other. The second cam shaft is disposed inside the second hole.

The electrical connecting assembly comprises an insulating base, a plurality of terminals, a PCB (printed circuit board), a cover, and a driving unit. The insulating base has a plurality of receiving holes and a first hole thereon. The terminals are disposed in the receiving holes, and the PCB is disposed under the insulating base. The PCB has a first connecting area corresponding to the receiving holes for welding the terminals on the first connecting area, and a second connecting area for the driving unit being welded on. The cover is disposed and can be moved horizontally on the insulating base for carrying the chip module. The cover has a plurality of opening holes corresponding to the receiving holes and the pins penetrate through the opening holes to connect with the terminals in the receiving holes, and the cover having a second hole. The driving unit at least has one metal sheath disposed in the first hole, a connecting portion disposed between the insulating base and the PCB, and one cam piece. The connecting portion has a welding portion corresponding to the second connecting area. The cam piece has an actuating portion, a first cam shaft extending from the actuating portion, and a second cam shaft formed between the first cam shaft and the actuating portion. The first cam shaft is disposed inside the first hole and the first cam shaft is held by the metal sheath. The second cam shaft and the first cam shaft are eccentric with each other. The second cam shaft is disposed inside the second hole.

Depending on the present invention, the electrical connecting assembly is provided for improving stability of the electrical connection. The metal sheath is disposed in the first hole and two ends of the welding portion are respectively connected to the metal sheath and the second connecting area. The first cam shaft which extends from the actuating portion is disposed the first hole corresponding to the metal sheath. Thereby, a part of the reaction force generated by the terminals acts on the metal sheath and is transferred to the PCB. The reaction force acts on the insulating base is reduced so that the expansion issue of the front end of the insulating base is avoided. Moreover, by positioning the first cam shaft into the metal sheath, the first cam shaft contacts with the first hole indirectly. Thereby, when the greater force for rotating cam piece is used, the reaction force generated by the terminals almost acts on the metal sheath and is transferred to the PCB so that the first hole is protected from the abrasion due to the greater force. In other words, the loose problem with the first cam shaft and the extended first hole is solved. The electrical connection of the device and the connector is improved.

In order to better understand the characteristics and technical contents of the present invention, a detailed description thereof will be made with reference to the accompanying drawings. However, it should be understood that the drawings and the description are illustrative but not used to limit the scope of the present invention.

DETAILED DESCRIPTION OF THE PREFERRED EMBODIMENTS

Figure 1:
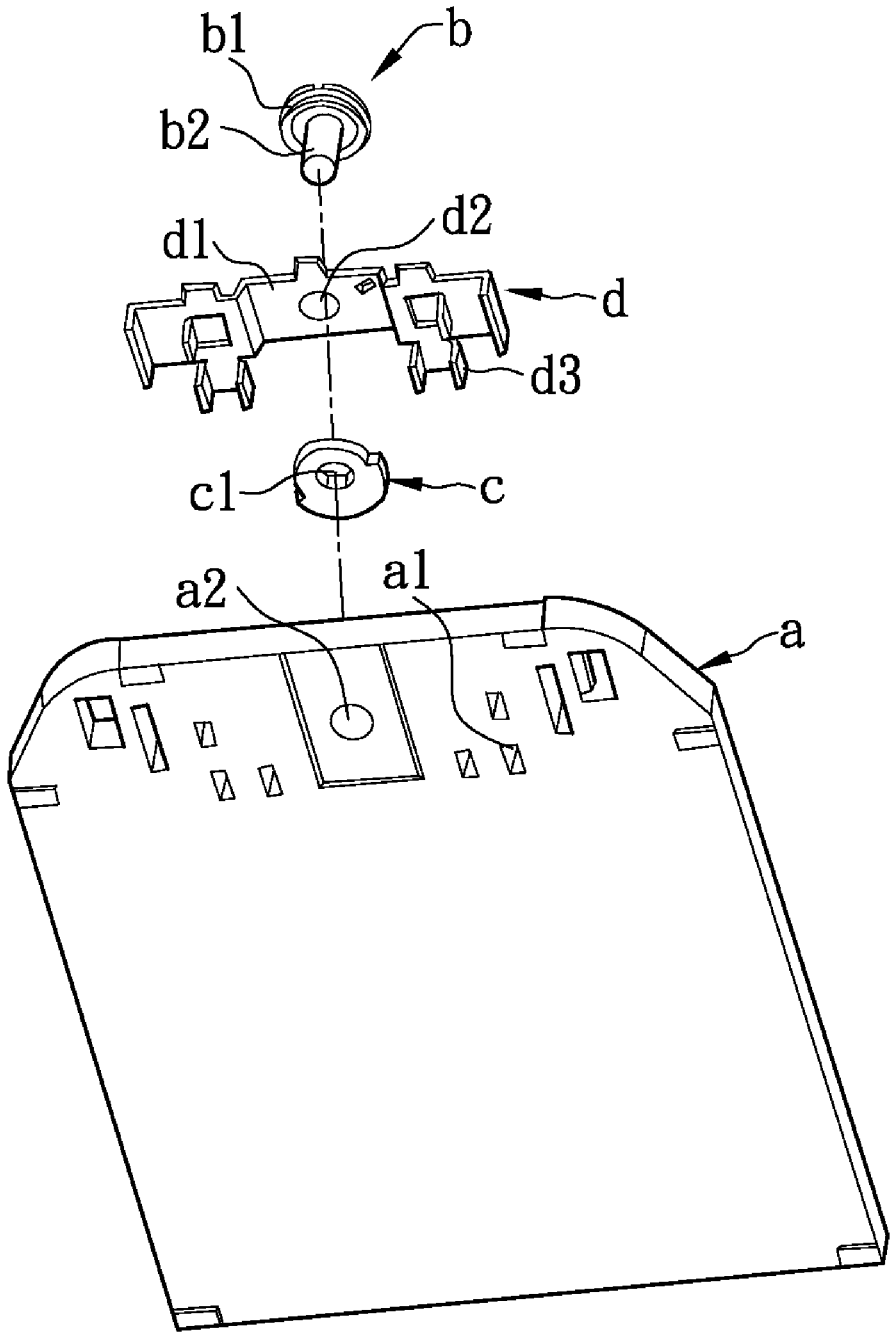
FIG. 1 PRIOR ART
FIG. 1 is an exploded view showing the traditional electrical connector.
Figure 2:
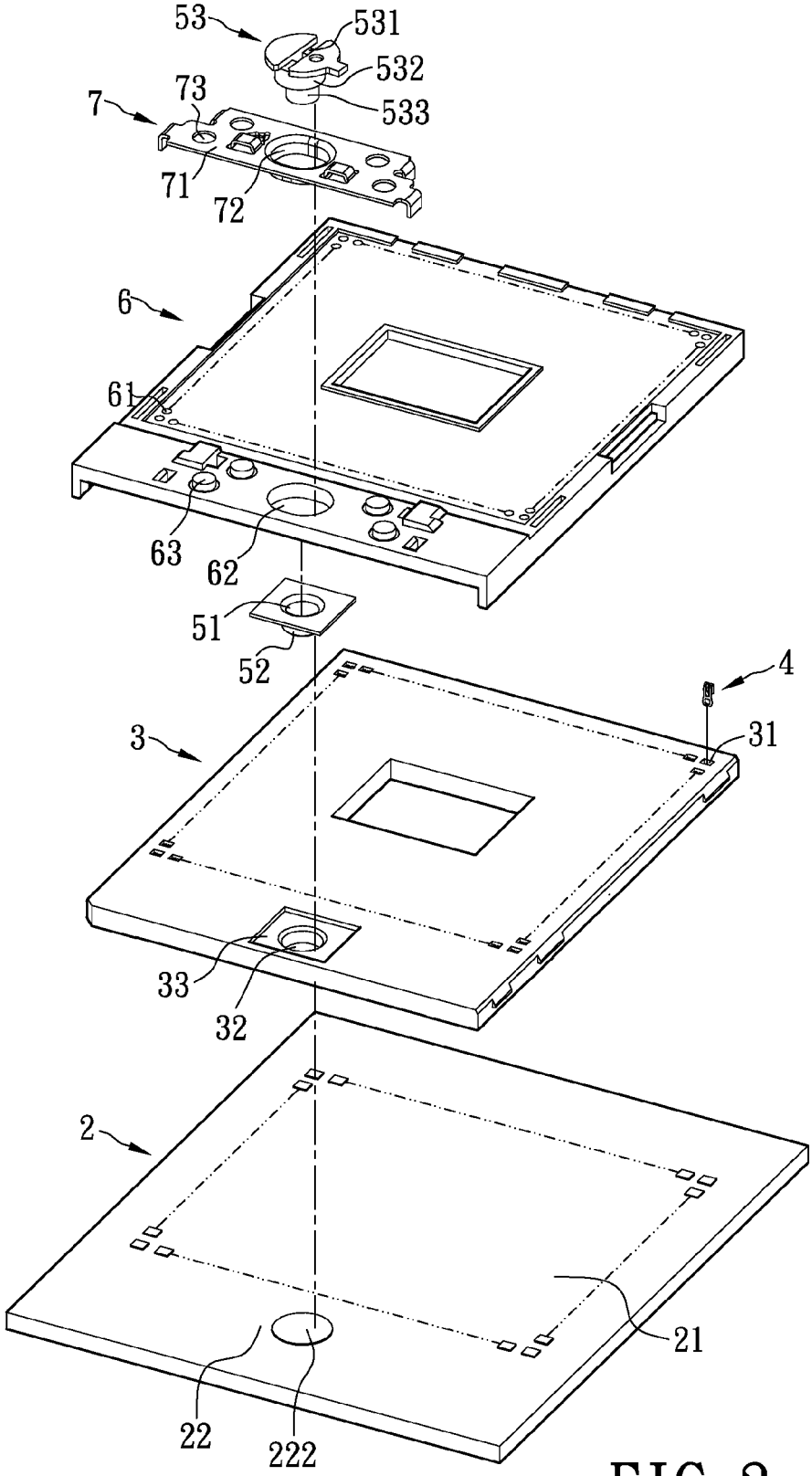
FIG. 2 shows an exploded view of the first embodiment of the electrical connecting assembly according to the present invention.
Figure 3:
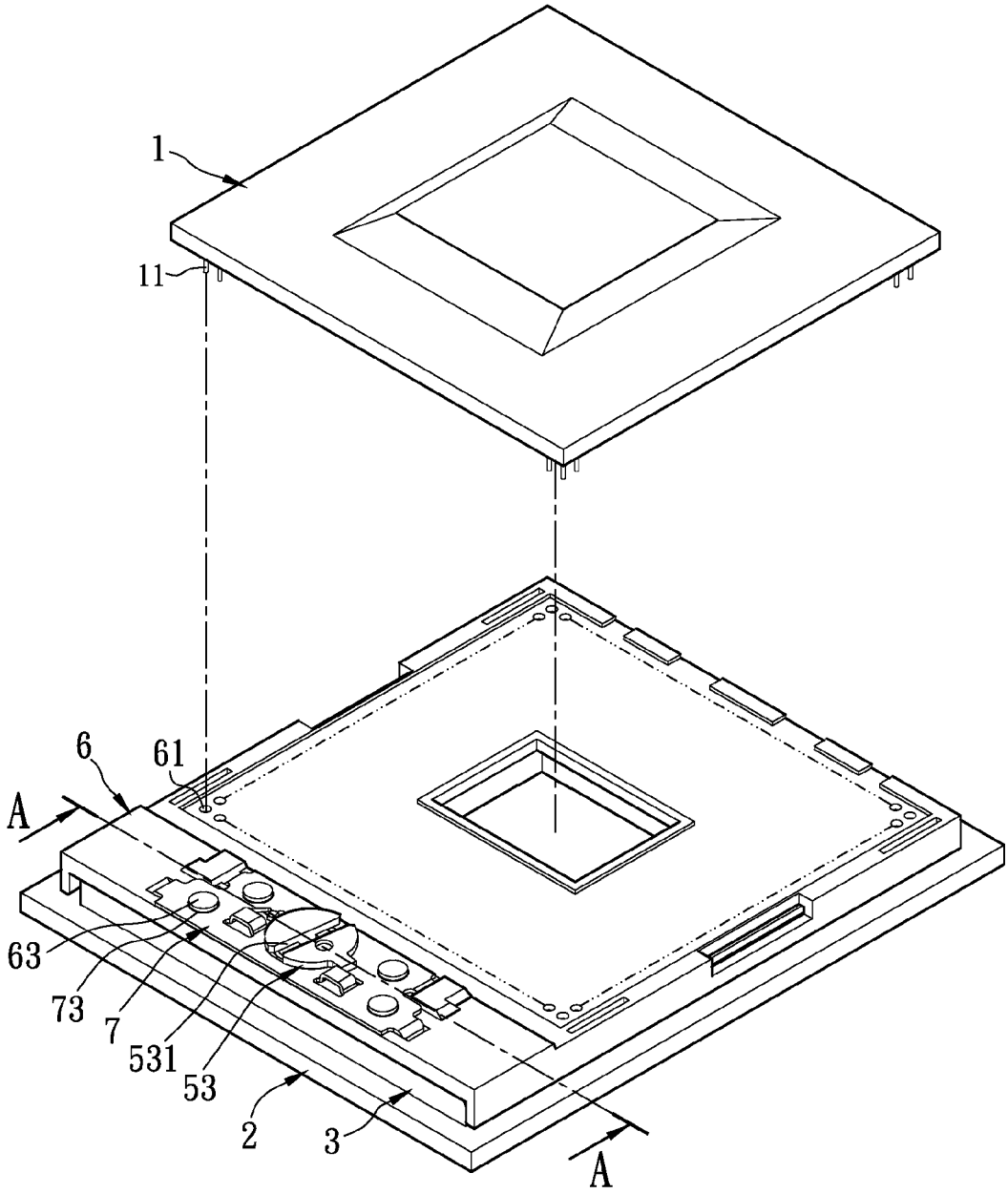
FIG. 3 shows the chip module assembled on the electrical connecting assembly according to the present invention.
Figure 4:
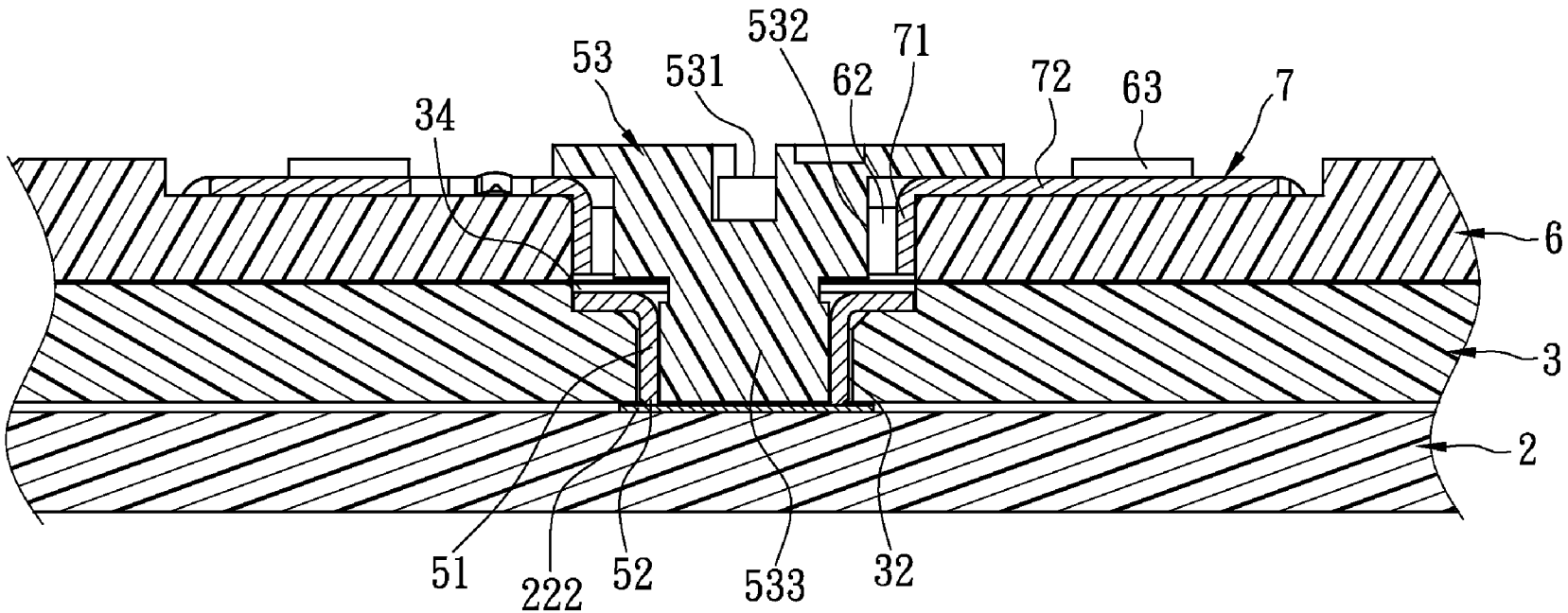
FIG. 4 is a cross-sectional view taken along a line A-A of FIG. 3.

Please refer to FIGS. 2 to 4, the invention discloses the first embodiment of an electrical connecting assembly and is applied for electrically connecting a chip module 1 with a printed circuit board 2 (hereinafter referred to as PCB). The electrical connecting assembly includes an insulating base 3 disposed on the PCB 2, a plurality of terminals 4 fixed in the insulating base 3, a driving unit 5, a cover 6 and a strength piece 7. The cover 6 covers the insulating base 3 and can slide horizontally and relatively to the insulating base 3, and the strength piece 7 is disposed on the cover 6.

The insulating base 3 has a plurality of receiving holes 31 for receiving the terminals 4 and the terminals 4 electrically connect with the PCB 2. On the other hand, the insulating base 3 has a first hole 32 thereon.

The PCB 2 is disposed under the insulating base 3. The PCB 2 has a first connecting area 21 corresponding to the receiving holes 31 so that the terminals 4 can be welded on the first connecting area 21. The PCB 2 further has a second connecting area 22 so that the driving unit 5 can be welded on the second connecting area 22. The second connecting area 22 has at least one connecting pad 222.

The driving unit 5 has a metal sheath 51 fixed on the insulating base 3 and the metal sheath 51 is received in the first hole 32. The metal sheath 51 has a welding portion 52 extending from the bottom thereof and the welding portion 52 is welded on the connecting pad 222 of the second connecting area 22. The driving unit 5 further has a cam piece 53. The cam piece 53 has an actuating portion 531, a second cam shaft 532 extending from the actuating portion 531, and a first cam shaft 533 extending from the second cam shaft 532. The first cam shaft 533 and the second cam shaft 532 are eccentric. When the cam piece 53 is assembled with the strength piece 7, the cover 6, and the insulating base 3, the first cam shaft 533 is inside the first hole 32 and the metal sheath 51 and the second cam shaft 532 is inside the shaft sheath 72 of the strength piece 7 and the second hole 62 of the cover 6. The actuating portion 531 is disposed on the surface of the strength piece 7. When the actuating portion 531 is driven by a tool (not shown), the second cam shaft 532 rotates to drive the cover 6 to move.

The cover 6 is disposed on the insulating base 3 and it moves horizontally. The cover 6 is used for carrying the chip module 1. The cover 6 has a plurality of opening holes 61 corresponding to the receiving holes 31 and the opening holes 61 are used for inserting the pins 11. The pins 11 penetrate through the opening holes 61 so as to connect with the terminals 4. The cover 6 has second hole 62 corresponding to the first hole 32 and four fixing pieces 63 thereon. The two pairs of the fixing pieces 63 are respectively disposed on the two side of the second hole 62.

The strength piece 7 is made of metal and is positioned on the cover 6 for improving the strength of the cover 6. The strength piece 7 has a plate 71 disposed between the actuating portion 531 and the cover 6 so that the actuating portion 531 abuts on the plate 71. A shaft sheath 72 extends downwardly from the plate 71 and the shaft sheath 72 inserts into the second hole 62. The second cam shaft 532 is positioned in the shaft sheath 72 so that the second cam shaft 532 can be rotated to abut against the inner surface of the shaft sheath 72. The plate 71 further has four fixing holes 73 and the fixing holes 73 are corresponding to the fixing pieces 63.

Alternatively, the plate 71 can have at least four fixing holes 73 thereon and the cover 6 has at least four fixing pieces 63 corresponding to the fixing holes 73.

In assembling processes, the metal sheath 51 is fixed on the insulating base 3 to insert the metal sheath 51 in the first hole 32 of the insulating base 3.

Next step is fixing the strength piece 7 on the cover 6 and the shaft sheath 72 is inserted into the second hole 62.

Next step is assembling the cover 6 on the insulating base 3 and aligning the second hole 62 with the first hole 32. Thereby, the metal sheath 51 is disposed between the cover 6 and insulating base 3.

Next step is inserting the cam piece 53 into the shaft sheath 72, the second hole 62, the metal sheath 51, and the first hole 32. The first cam shaft 533 is inside the metal sheath 51 and the second cam shaft 532 is inside the shaft sheath 72. The second cam shaft 532 can be used for driving the cover 6 by abutting the inner surfaces of the shaft sheath 72 and the second hole 62. The actuating portion 531 connects with the cover 6 and is disposed on the strength piece 7, in other words, the strength piece 7 is positioned between the actuating portion 531 and the cover 6. Please refer to FIG. 4, the metal sheath 51 is disposed between the inner surface of the first hole 32 and the first cam shaft 533, and the electrical connector is assembled completely.

Next step is assembling the electrical connector on the PCB 2. Then, the terminals 4 and the welding portion 52 of the metal sheath 51 are respectively welded to the first connecting area 21 and the connecting pad 222.

The chip module 1 is disposed on the cover 6 and each pin 11 of the chip module 1 is inserted into the corresponding opening hole 61 and extends into the insulating base 3.

A tool (not shown), such as a screw driver is used for rotating the actuating portion 531 so as to move the cover 6 by the second cam shaft 532. The cover 6 slides in a closed position and an opened position by the rotation of the cam piece 53. In the open position, the pins 11 do not contact with the terminals 4. The pins 11 electrically contact with the terminals 4 in the close position. During the connecting of the pins 11 and the terminals 4, the pins 11 force on the terminals 4 and simultaneously the terminals 4 force on the pins 11. Because the pins 11 are disposed inside the opening holes 61 of the cover 6 and the second cam shaft 532 contacts with the cover 6, the reaction force to the pins 11 will be transferred to the second cam shaft 532. Still because the first cam shaft 533 is formed by extending from the second cam shaft 532, a force with the same intensity and an opposite direction of the reaction acting on the second cam shaft 532 acts on the first cam shaft 533. The force further acts on the metal sheath 51 because the first cam shaft 533 is inserted in the metal sheath 51. Still because the metal sheath 51 is disposed on the insulating base 3, the force acting on the metal sheath 51 is transferred to the PCB 2 via the insulating base 3 so that the force acting on the insulating base 3 can be reduced. Thereby, the expansion of the front end of the insulating base 3 (the position of the receiving slot 33) is avoided so as to improve the stability of the electrical connection.

Furthermore, by positioning the first cam shaft 533 into the metal sheath 51, the first cam shaft 533 contacts with the first hole 32 indirectly. Thereby, when the greater force for rotating the cam piece 53 is used, the reaction force generated by the terminals 4 almost acts on the metal sheath 51 and is transferred to the PCB 2 so that the first hole 32 is protected from the abrasion due to the greater force. In other words, the loose problem with the first cam shaft 533 and the extended first hole 32 is solved. The electrical connection of the device and the connector is improved.

Figure 5:
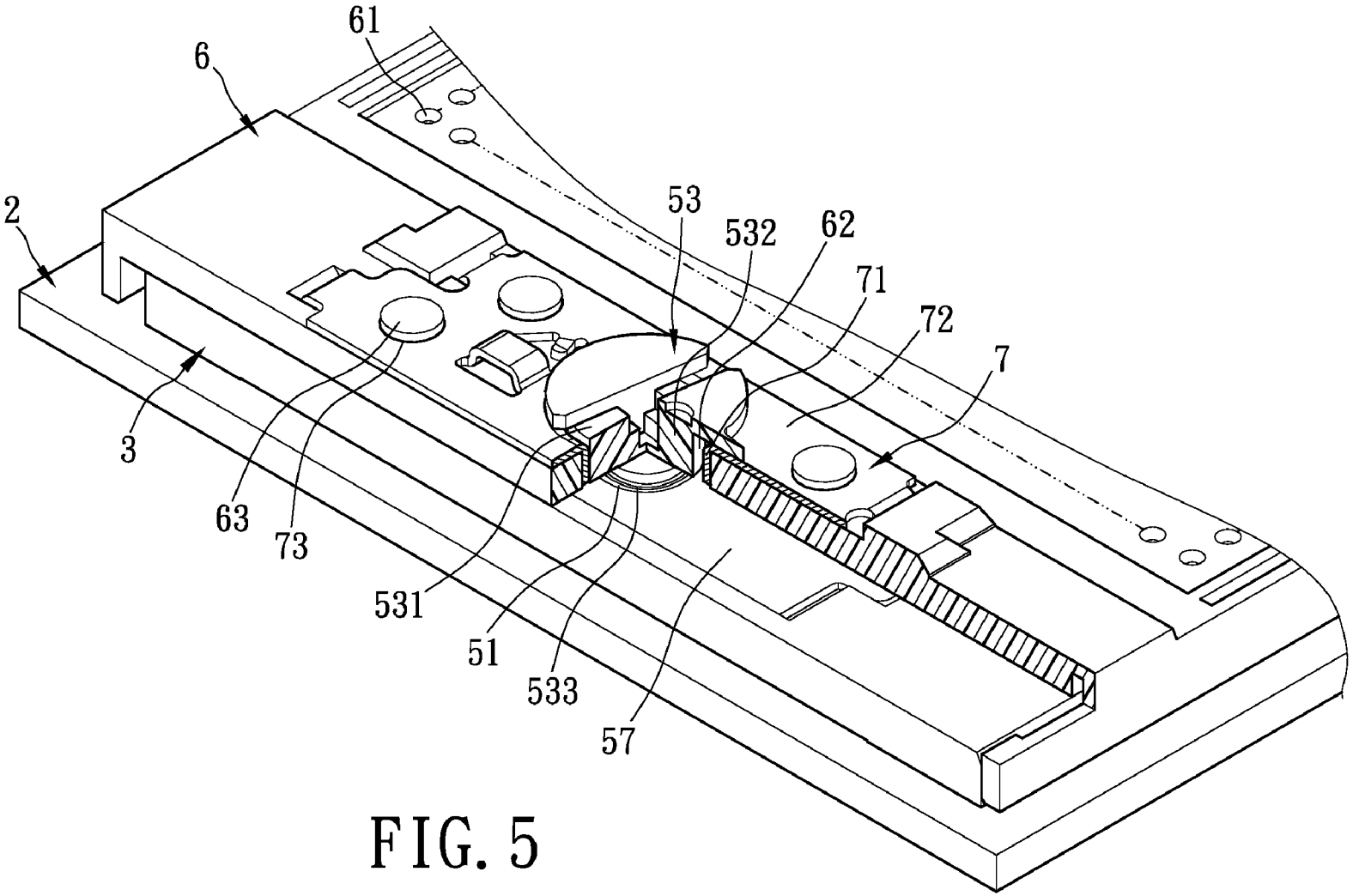
FIG. 5 is a partial cut-view of the second embodiment of the electrical connecting assembly according to the present invention.

FIG. 5 shows the second embodiment of the present invention. The difference between the second and the first embodiment is that the top surface of the metal sheath 51 is extending laterally to from an extending plate 57. The extending plate 57 is located in the receiving slot 33 concavely formed on the insulating base 3 for increasing the strength of the insulating base 3. Moreover, the height of the metal sheath 51 is greater than the thickness of the extending plate 57.

Figure 6:
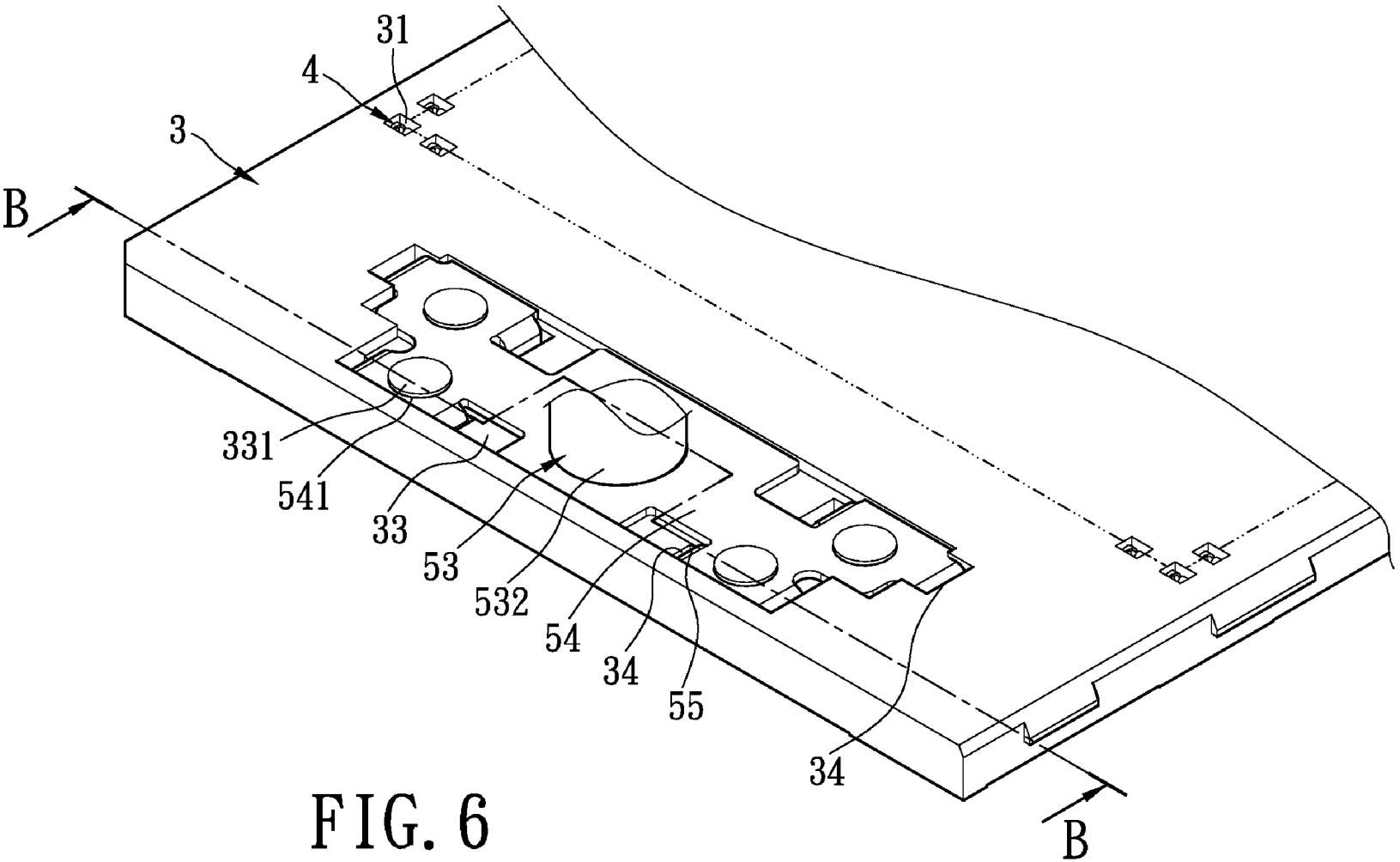
FIG. 6 is a schematic view showing the third embodiment of the electrical connecting assembly according to the present invention.
Figure 7:
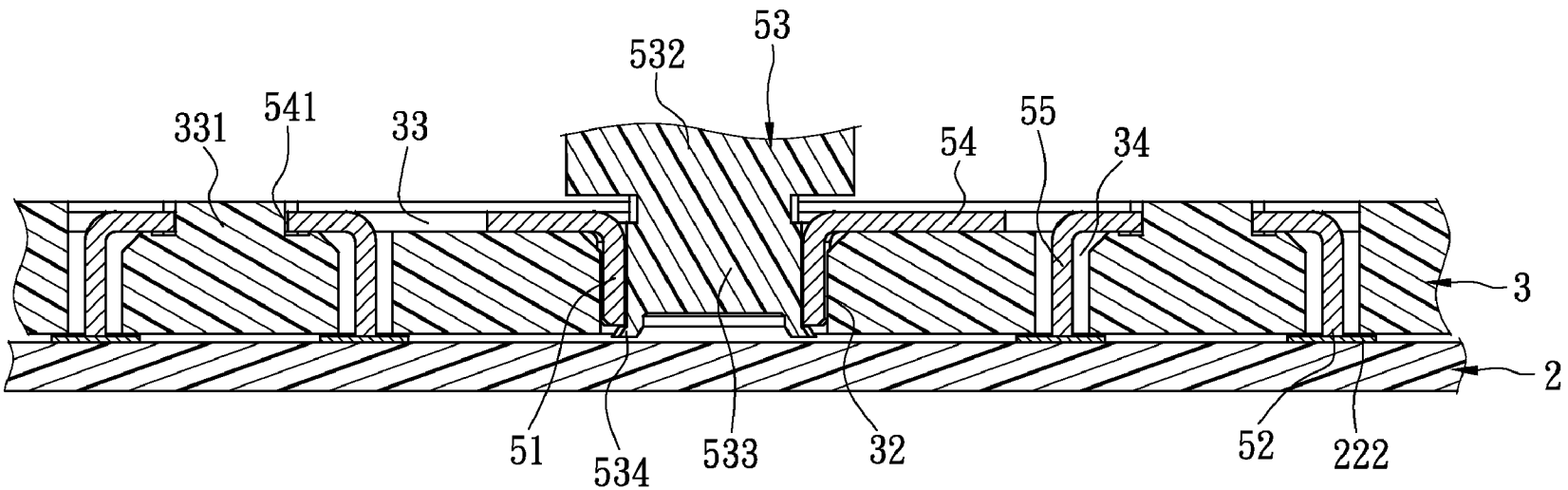
FIG. 7 is a cross-sectional view taken along a line B-B of FIG. 6.

FIGS. 6 and 7 show the third embodiment of the present invention. The difference between the third and the above-mentioned embodiments is that the bottom of the first cam shaft 533 has a hook portion 534 for locking the first cam shaft 533 with the metal sheath 51. Thereby, the first cam shaft 533 is fixed on the metal sheath 51 and does not move vertically.

Furthermore, a connecting portion 54 is disposed in the receiving slot 33, the insulating base 3 has eight position holes 34 thereon. Four position holes 34 are located on either side of the metal sheath 51. The connecting portion 54 is bended downwardly to form eight position portions 55 and each position portion 55 is inserted into the corresponding position hole 34. The welding portion 52 is formed on the end of the position portion 55. The connecting portion 54 connects between the metal sheath 51 and the position portions 55. The position portions 55 are inserted into the position holes 34 and the welding portion 52 is welded on the connecting pad 222 of the second connecting area 22. In other embodiments, the connecting portion 54 can have more than eight or less than eight position portions 55 which are inserted into the corresponding position holes 34 and are welded to the corresponding connecting pad 222 respectively.

On the other hand, the connecting portion 54 further has at least four or less than four position slots 541 in accordance with at least four or less than four position pins 331. The height of the metal sheath 51 is greater than the thickness of the connecting portion 54.

Figure 8:
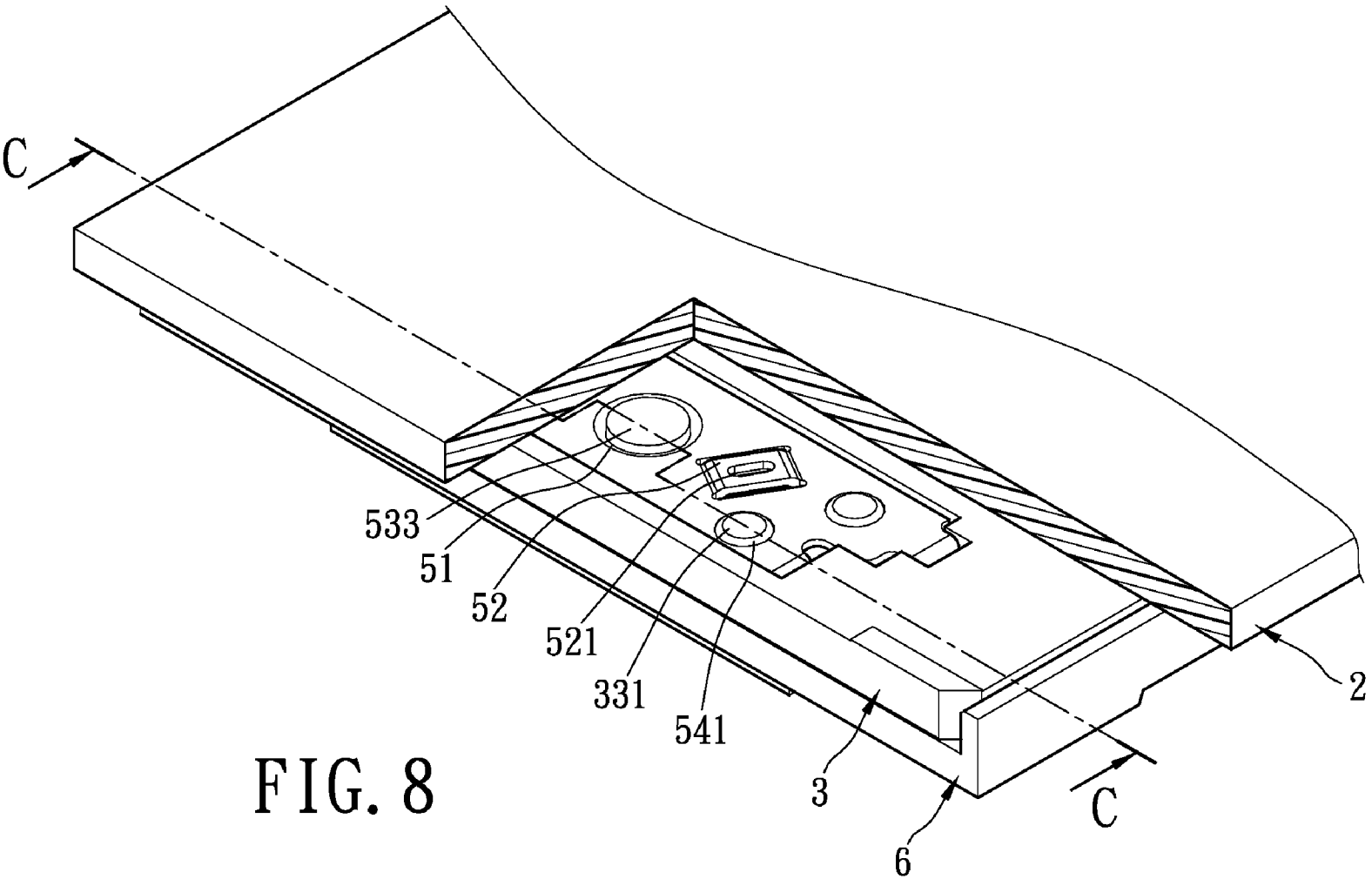
FIG. 8 is a partial cross-sectional view of the fourth embodiment of the inverted electrical connecting assembly according to the present invention.
Figure 9:
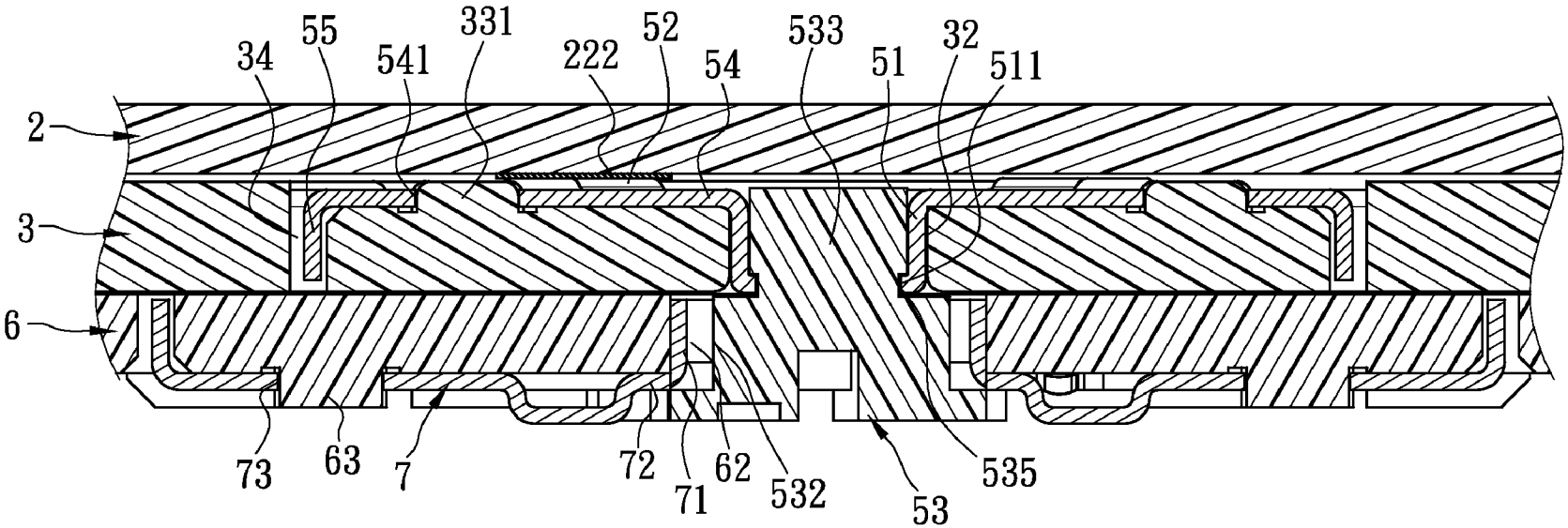
FIG. 9 is a cross-sectional view taken along a line C-C of FIG. 8.

Please refer to FIGS. 8 and 9, the fourth embodiment of the present invention is shown. The bottom of the insulating base 3 has the receiving slot 33 and the position pins 331. The metal sheath 51 is disposed inside the receiving slot 33 on the bottom of the insulating base 3 and is located between the insulating base 3 and the PCB 2. The welding portion 52 extends from the connecting portion 54 and the two ends of the welding portion 52 are both connected to the connecting portion 54 (one end of the welding portion 52 connects to the connecting portion 54 in other embodiments). The welding portions 52 are symmetrically disposed on two side of the metal sheath 51 so that the welding portion 52 is welded horizontally with the PCB 2. The welding portion 52 has a holding hole 521 to prevent the connecting pad 222 form accumulating the welding portion 52 when the welding portion 52 is welded on the connecting pad 222.

Moreover, the first cam shaft 533 has a neck portion 535 concavely on the opposite sides. The metal sheath 51 has an abutting portion 511 which is locked in the neck portion 535 so that the cam piece 53 does not move vertically.

The difference between the first embodiment and the present embodiment is that the metal sheath 51 is assembled on the bottom of the insulating base 3. Alternatively, the metal sheath 51 is assembled on the top of the insulating base 3 in the first embodiment.

Figure 10:
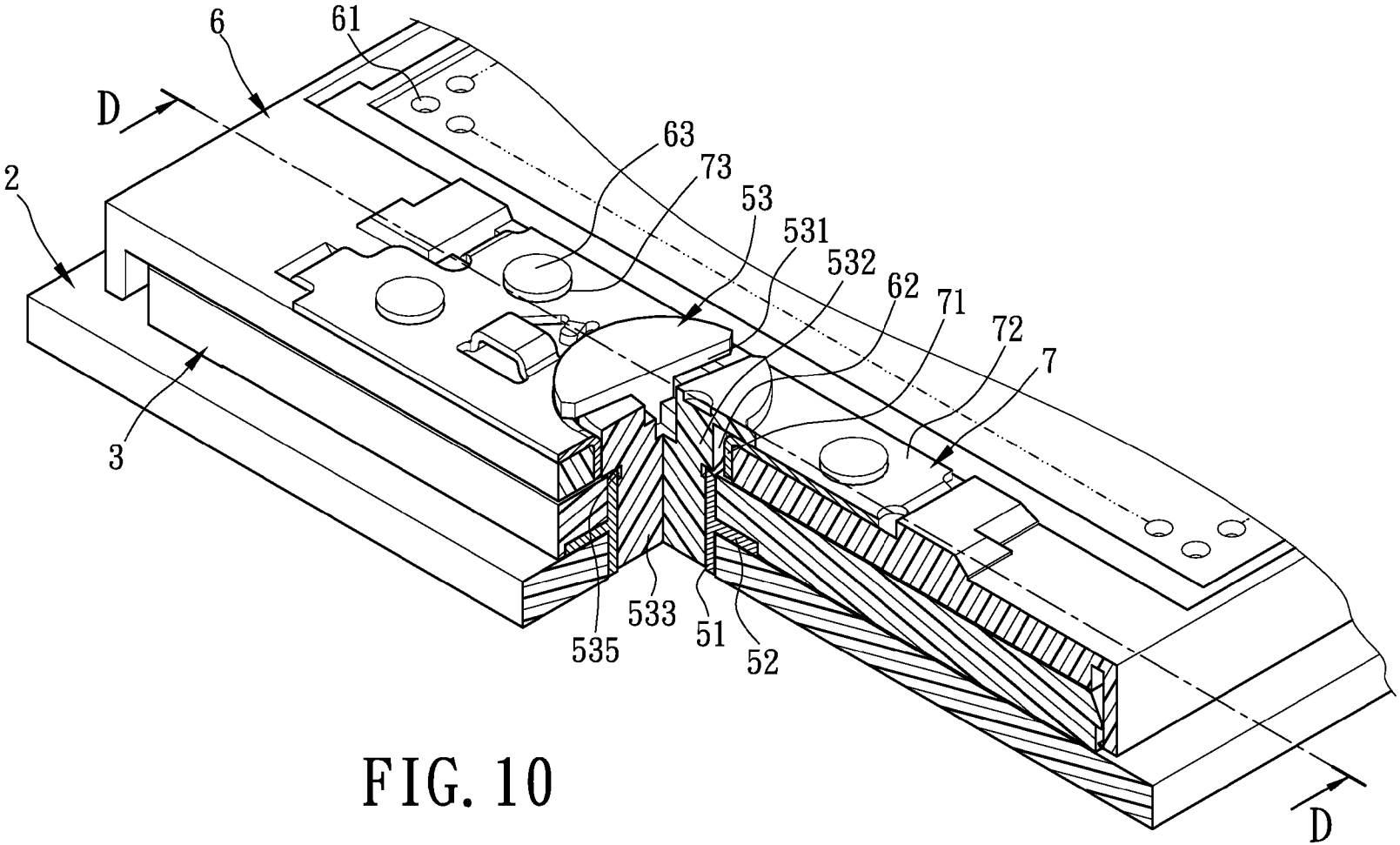
FIG. 10 is a partial cross-sectional view of the fifth embodiment of the electrical connecting assembly according to the present invention.
Figure 11:
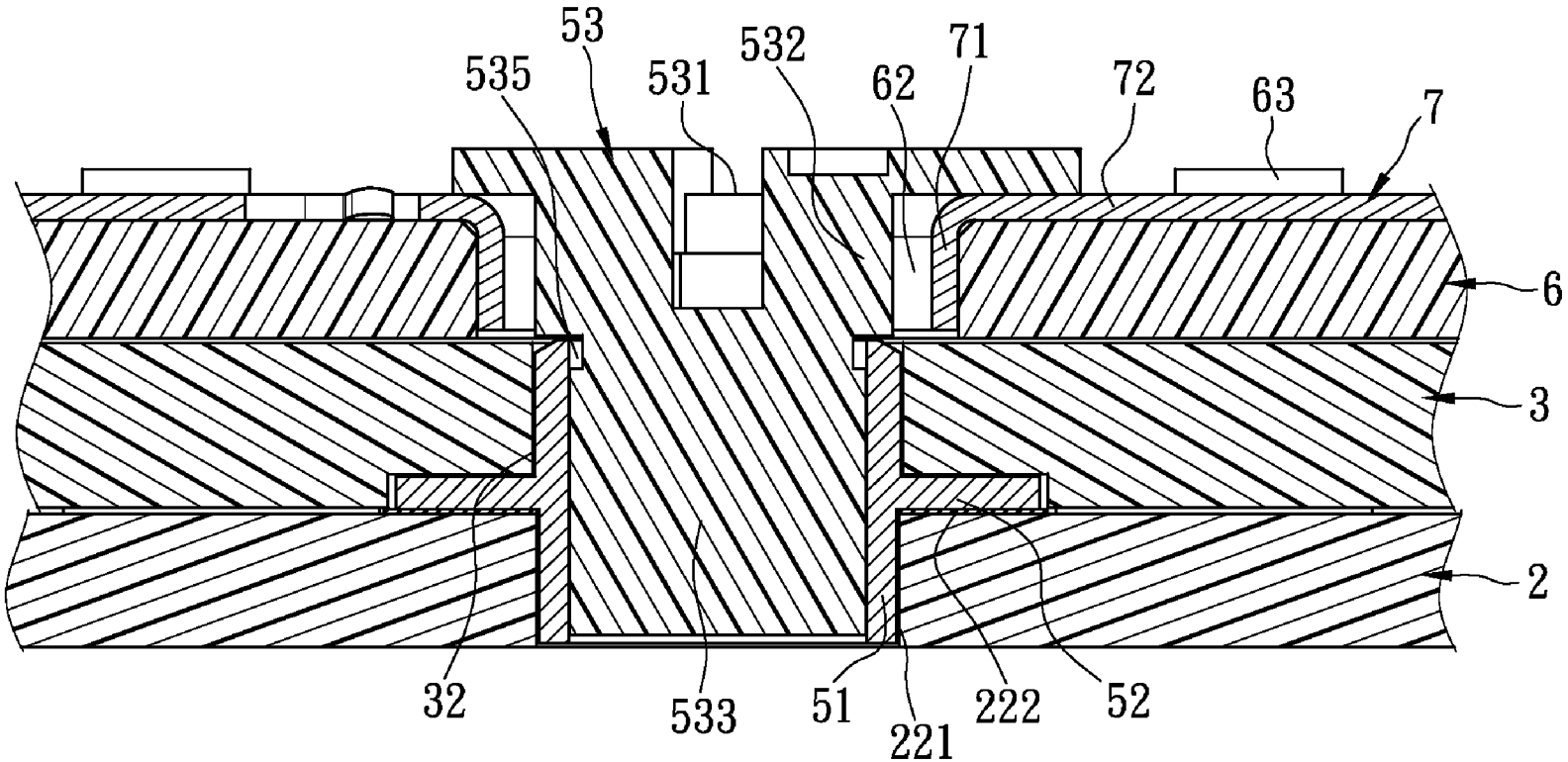
FIG. 11 is a cross-sectional view taken along a line D-D of FIG. 10.

FIGS. 10 and 11 show the fifth embodiment of the present invention. The second connecting area 22 has a through hole 221, and the connecting pad 222 is disposed surrounding the through hole 221. The metal sheath 51 is inserted into the through hole 221. The welding portion 52 is extended laterally from the side of the metal sheath 51 and the extended welding portion 52 is disposed between the insulating base 3 and the second connecting area 22.

Figure 12:
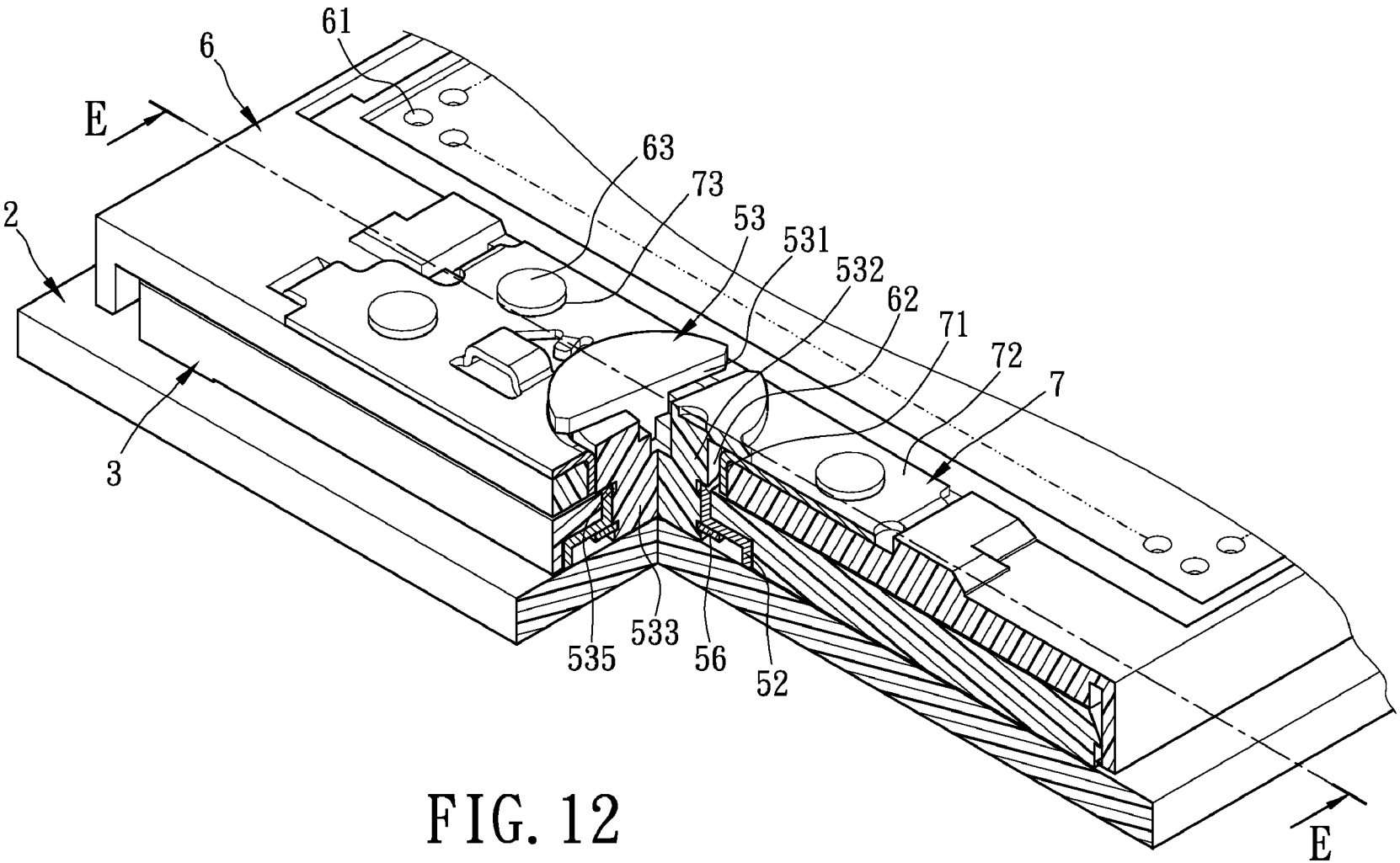
FIG. 12 is a partial cross-sectional view of the sixth embodiment of the electrical connecting assembly according to the present invention.
Figure 13:
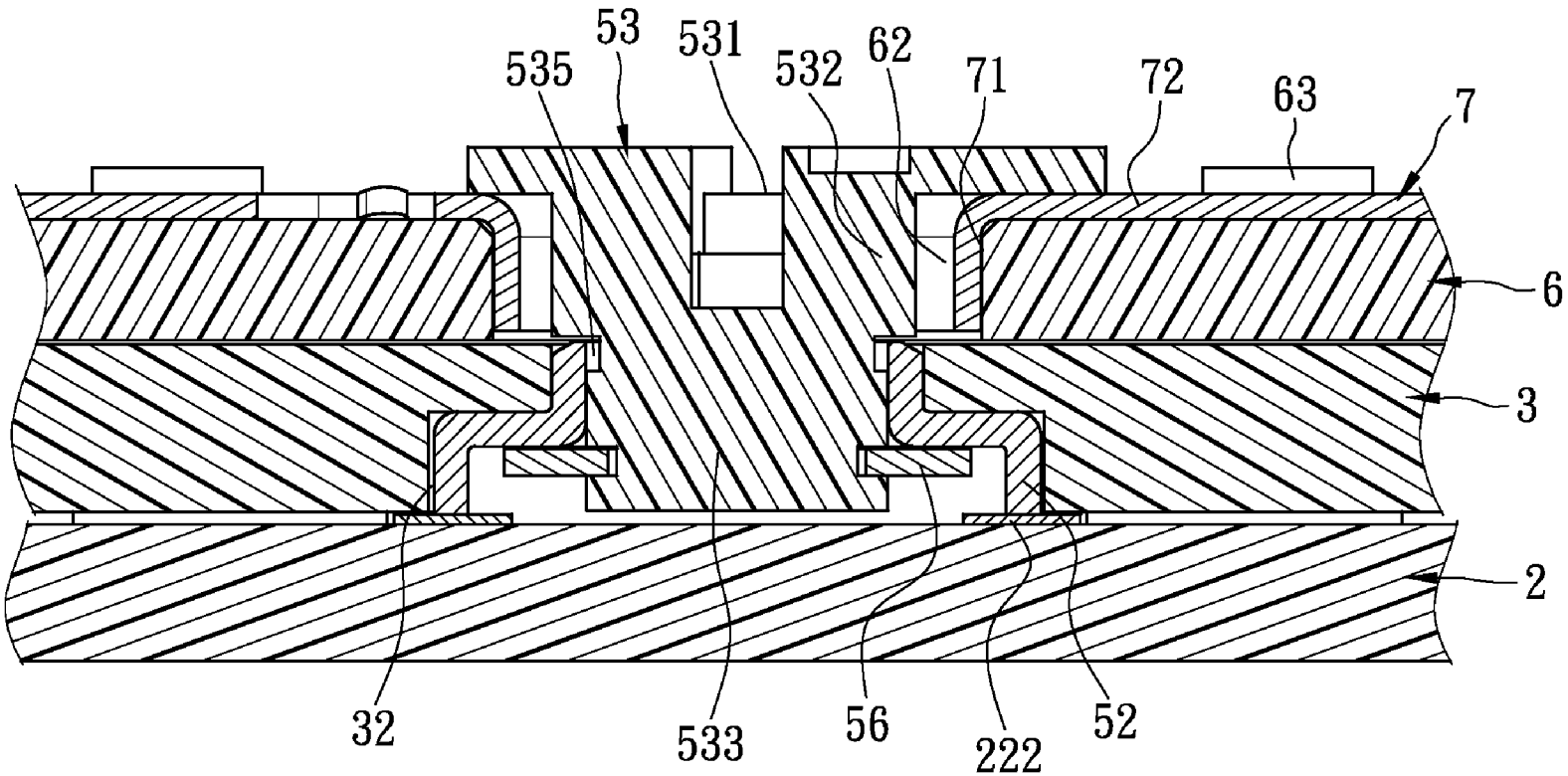
FIG. 13 is a cross-sectional view showing taken along a line E-E of FIG. 12.

FIGS. 12 and 13 show the sixth embodiment of the present invention. The first cam shaft 533 has a neck portion 535 thereon. A stop piece 56 circularly holds the neck portion 535 and the stop piece 56 is disposed under the metal sheath 51 to prevent the cam piece 53 from moving vertically. To sum up, the present invention has the following advantages:

1. The metal sheath is disposed in the first hole and two ends of the welding portion are respectively connected to the metal sheath and the second connecting area. The first cam shaft which extends from the actuating portion is disposed in the first hole corresponding to the metal sheath. Thereby, a part of the reaction force generated by the terminals acts on the metal sheath and is transferred to the PCB. The reaction force acts on the insulating base is reduced so that the expansion issue of the front end of the insulating base is avoided. The stability of the electrical connection is improved.
2. By positioning the first cam shaft into the metal sheath, the first cam shaft contacts with the first hole indirectly. Thereby, when the greater force for rotating cam piece is used, the reaction force generated by the terminals almost acts on the metal sheath and is transferred to the PCB so that the first hole is protected from the abrasion due to the greater force. In other words, the loose problem with the first cam shaft and the extended first hole is solved. The electrical connection of the device is improved.

Although the present invention has been described with reference to the foregoing preferred embodiments, it will be understood that the invention is not limited to the details thereof. Various equivalent variations and modifications may occur to those skilled in this art in view of the teachings of the present invention. Thus, all such variations and equivalent modifications are also embraced within the scope of the invention as defined in the appended claims.

What is claimed is:

1. An electrical connecting assembly, used for electrically connecting a chip module having a plurality of pins on the bottom thereof, the electrical connecting assembly comprising:

an insulating base having a plurality of receiving holes and a first hole thereon;

a plurality of terminals disposed in the receiving holes;

a printed circuit board disposed under the insulating base, the printed circuit board having a first connecting area corresponding to the receiving holes for welding the terminals on the first connecting area, and the printed circuit board further having a second connecting area;

a cover disposed and moving horizontally on the insulating base for carrying the chip module, the cover having a plurality of opening holes corresponding to the receiving holes, the pins penetrating through the opening holes to connect with the terminals in the receiving holes, and the cover having a second hole; and a driving unit welded on the second connecting area, the driving unit at least having one metal sheath disposed in the first hole, at least one welding portion, and one cam piece, one end of the welding portion connected to the metal sheath, the other end of the welding portion being welded on the second connecting area, the cam piece having an actuating portion, a first cam shaft extending from the actuating portion, and a second cam shaft formed between the first cam shaft and the actuating portion, the first cam shaft being disposed inside the first hole and the first cam shaft being held by the metal sheath, the second cam shaft being eccentric with the first cam shaft, and the second cam shaft being disposed inside the second hole.

2. The electrical connecting assembly according to claim 1, wherein the welding portion is extended from the bottom of the metal sheath.

3. The electrical connecting assembly according to claim 1, wherein the second connecting area of the printed circuit board further has at least one through hole for receiving the metal sheath.

4. The electrical connecting assembly according to claim 3, wherein the printed circuit board further has at least one connecting pad on the second connecting area and the welding portion of the metal sheath is welded on the connecting pad.

5. The electrical connecting assembly according to claim 1, wherein the welding portion is extended laterally from the side of the metal sheath and is disposed between the insulating base and the second connecting area.

6. The electrical connecting assembly according to claim 1, wherein the first cam shaft has a neck portion thereon, a stop piece circularly holds the neck portion and the stop piece is disposed under the metal sheath.

7. An electrical connecting assembly, used for electrically connecting a chip module having a plurality of pins on the bottom thereof, the electrical connecting assembly comprising:

an insulating base having a plurality of receiving holes and a first hole thereon;

a plurality of terminals disposed in the receiving holes;

a printed circuit board disposed under the insulating base, the printed circuit board having a first connecting area corresponding to the receiving holes for welding the terminals on the first connecting area, and the printed circuit board further having a second connecting area;

a cover disposed and moving horizontally on the insulating base for carrying the chip module, the cover having a plurality of opening holes corresponding to the receiving holes, the pins penetrating through the opening holes to connect with the terminals in the receiving holes, and the cover having a second hole; and a driving unit welded on the second connecting area, the driving unit at least having one metal sheath disposed in the first hole, at least one welding portion, one end of the welding portion welded on the second connecting area, a connecting portion disposed on the insulating base and one cam piece, the connecting portion connecting the metal sheath and the welding portion, the cam piece having an actuating portion, a first cam shaft extending from the actuating portion, and a second cam shaft formed between the first cam shaft and the actuating portion, the first cam shaft being disposed inside the first hole and the first cam shaft being held by the metal sheath, the second cam shaft being eccentric with the first cam shaft, and the second cam shaft being disposed inside the second hole.

8. The electrical connecting assembly according to claim 7, wherein the insulating base has at least one position hole thereon, a position portion extended from the position portion is inserted into the position hole.

9. The electrical connecting assembly according to claim 8, wherein the position portion extends downwardly to form the welding portion.

10. The electrical connecting assembly according to claim 7, wherein the bottom of the first cam shaft bends outwardly to form a hook portion for locking the metal sheath.

11. The electrical connecting assembly according to claim 7, wherein the height of the metal sheath is greater than the thickness of the connecting portion.

12. The electrical connecting assembly according to claim 7, wherein the second connecting area of the printed circuit board further has a through hole for receiving the metal sheath.

13. The electrical connecting assembly according to claim 7, wherein the connecting portion further has at least one position slot and the insulating base has at least one position pin corresponding to the position slot.

14. The electrical connecting assembly according to claim 7, wherein the insulating base further has a receiving slot for accommodating the connecting portion.

15. The electrical connecting assembly according to claim 7, further comprising a strength piece disposed on the cover, wherein the strength piece has a shaft sheath extending downwardly therefrom, the second cam shaft is positioned in the shaft sheath, and abuts against the shaft sheath.

16. The electrical connecting assembly according to claim 15, wherein strength piece further has a plate disposed between the actuating portion and the cover for supporting the actuating portion, and the shaft sheath extends downwardly from the plate.

17. An electrical connecting assembly, used for electrically connecting a chip module having a plurality of pins on the bottom thereof, the electrical connector comprising:

an insulating base having a plurality of receiving holes and a first hole thereon;

a plurality of terminals disposed in the receiving holes;

a printed circuit board disposed under the insulating base, the printed circuit board having a first connecting area corresponding to the receiving holes for welding the terminals on the first connecting area, and the printed circuit board further having a second connecting area;

a cover disposed and moving horizontally on the insulating base for carrying the chip module, the cover having a plurality of opening holes corresponding to the receiving holes, the pins penetrating through the opening holes to connect with the terminals in the receiving holes, and the cover having a second hole; and a driving unit welded on the second connecting area, the driving unit at least having one metal sheath disposed in the first hole, a connecting portion disposed between the insulating base and the printed circuit board, and one cam piece, the connecting portion connected to the metal sheath, the connecting portion having at least one welding portion corresponding to the second connecting area, the cam piece having an actuating portion, a first cam shaft extending from the actuating portion, and a second cam shaft formed between the first cam shaft and the actuating portion, the first cam shaft being disposed inside the first hole and the first cam shaft being held by the metal sheath, the second cam shaft being eccentric with the first cam shaft, and the second cam shaft being disposed inside the second hole.

18. The electrical connecting assembly according to claim 17, wherein the first cam shaft has at least one neck portion and the metal sheath has at least one abutting portion locked in the neck portion.

19. The electrical connecting assembly according to claim 17, wherein the welding portion has at least one holding hole.

20. The electrical connecting assembly according to claim 17, wherein the second connecting area of the printed circuit board further has at least one through hole for receiving the metal sheath.

21. The electrical connecting assembly according to claim 17, wherein the insulating base has at least one position hole thereon, a position portion extended from the connecting portion is inserted into the position hole.

22. The electrical connecting assembly according to claim 21, wherein the position portion extends downwardly to form the welding portion.

23. The electrical connecting assembly according to claim 17, further comprising a strength piece disposed on the cover, wherein the strength piece has a shaft sheath extending downwardly therefrom, the second cam shaft is positioned in the shaft sheath, and the second cam shaft abuts against the shaft sheath.

24. The electrical connecting assembly according to claim 23, wherein the strength piece further has a plate disposed between the actuating portion and the cover for supporting the actuating portion, and the shaft sheath extends downwardly from the plate.

* * * * *